US010398963B2

(12) United States Patent
Treadway

(10) Patent No.: US 10,398,963 B2
(45) Date of Patent: Sep. 3, 2019

(54) WEARABLE MOBILITY DEVICE

(71) Applicant: ACTON, INC., Santa Clara, CA (US)

(72) Inventor: Peter Treadway, Pleasanton, CA (US)

(73) Assignee: Acton, Inc., Pleasanton, CA (US)

( * ) Notice: Subject to any disclaimer, the term of this patent is extended or adjusted under 35 U.S.C. 154(b) by 0 days.

(21) Appl. No.: 15/859,001

(22) Filed: Dec. 29, 2017

(65) Prior Publication Data

US 2018/0117449 A1 May 3, 2018

Related U.S. Application Data

(63) Continuation of application No. 14/183,435, filed on Feb. 18, 2014, now Pat. No. 9,855,489, which is a continuation of application No. 13/296,088, filed on Nov. 14, 2011, now Pat. No. 8,684,121.

(60) Provisional application No. 61/519,062, filed on May 15, 2011.

(51) Int. Cl.

| | |
|---|---|
| ***A63C 17/12*** | (2006.01) |
| ***A63C 17/00*** | (2006.01) |
| *A63C 17/04* | (2006.01) |
| *A63C 17/14* | (2006.01) |

(52) U.S. Cl.

CPC ..... *A63C 17/12* (2013.01); *A63C 17/006* (2013.01); *A63C 17/0033* (2013.01); *A63C 17/04* (2013.01); *A63C 17/1436* (2013.01); *A63C 2203/12* (2013.01); *A63C 2203/14* (2013.01); *A63C 2203/22* (2013.01); *A63C 2203/50* (2013.01)

(58) Field of Classification Search

CPC ... A63C 17/12; A63C 17/006; A63C 17/0033; A63C 17/04; A63C 17/1436; A63C 2203/50; A63C 2203/12; A63C 2203/14; A63C 2203/22; G08C 2201/93; B60K 2007/0053; B60K 2007/0069; B60K 2007/0084

See application file for complete search history.

(56) References Cited

U.S. PATENT DOCUMENTS 336,603 A * 2/1886 Towle ..... A63C 17/02 280/11.19
863,675 A * 8/1907 Towle ..... A63C 17/02 280/11.19

(Continued)

*Primary Examiner* — James A Shriver, II
*Assistant Examiner* — Steve Clemmons
(74) *Attorney, Agent, or Firm* — Sheppard Mullin Richter & Hampton LLP

(57) ABSTRACT

A wearable mobility device comprising a base for the placement of a shoe, the base including a heel-support section, a battery pack, a tail reflector, and a wireless receiver. The device including a first wheel having a wheel hub motor embedded therein, the motor rotatably connected to a first partial axial shaft connected to the base. The device including a second wheel having a wheel hub motor controller embedded therein, the motor controller rotatably connected to a second partial axial shaft connected to the base and operative to control a speed of rotation of the first wheel and the second wheel. The device also including a remote control for controlling the speed of rotation of the first wheel and the second wheel, the remote control operative to transmit one or more control signals to the wireless receiver, the wireless receiver being electrically coupled to the motor controller.

13 Claims, 15 Drawing Sheets

(56) References Cited

U.S. PATENT DOCUMENTS 1,672,700 A * 6/1928 Vass ..... A63C 17/02 180/181
1,735,404 A * 11/1929 Masury ..... B60K 7/0007 180/65.6
3,876,032 A * 4/1975 Ferino ..... A63C 17/10 180/181
4,817,974 A * 4/1989 Bergeron ..... A63C 17/004 280/11.19
5,236,058 A * 8/1993 Yamet ..... A63C 17/12 180/181
5,547,204 A * 8/1996 Gamzo ..... A63C 5/031 280/11.19
6,059,062 A * 5/2000 Staelin ..... A63C 17/12 180/181
6,428,050 B1 * 8/2002 Brandley ..... A63C 17/12 280/11.19
6,497,421 B1 * 12/2002 Edgerley ..... A43B 3/26 280/11.19
6,604,593 B1 * 8/2003 Mullet ..... A63C 17/12 180/181
7,481,291 B2 * 1/2009 Nishikawa ..... B62K 17/00 180/181
7,610,972 B2 * 11/2009 Adams ..... A63C 17/008 180/180
9,526,977 B2 * 12/2016 Edney ..... A63C 17/12
2003/0020244 A1 * 1/2003 Sung ..... A63C 17/04 280/11.19
2004/0041359 A1 * 3/2004 Im ..... A63C 17/08 280/11.25
2007/0164521 A1 * 7/2007 Robinson ..... A43B 3/0005 280/11.19
2009/0120705 A1 * 5/2009 McKinzie ..... A63C 17/008 180/181
2010/0109266 A1 * 5/2010 Jenkins ..... A63C 17/006 280/11.204
2010/0127466 A1 * 5/2010 Green ..... A63C 17/0086 280/11.19

* cited by examiner

WEARABLE MOBILITY DEVICE

CROSS-REFERENCE TO RELATED APPLICATION

This application is a continuation application of U.S. patent application Ser. No. 14/183,435, filed Feb. 18, 2014, entitled "Wearable Mobility Device," which is a continuation application of U.S. patent application Ser. No. 13/296,088, filed Nov. 14, 2011, entitled "Wearable Mobility Device," which claims priority to U.S. Provisional Application No. 61/519,062, filed May 15, 2011, entitled "SpnKIX Wearable Mobility Device," the contents of which are hereby incorporated by reference in their entirety.

FIELD

The present disclosure relates generally to personal mobility devices, and in particular but not exclusively, relates to a wearable mobility device for providing a streamlined means of urban and suburban transportation.

BACKGROUND

Various forms of personal transportation are fun to use but are also burdensome and are often banned from public and private areas. Teenagers use scooters, rollerblades, skateboards, bicycles, and even cars to speed up their travel. With the exception of cars, however, each of these personal transportation options has limited usefulness since they must be carried when not in use. Skateboards are not really designed for multi-terrain environments. They provide fun but require a good deal of skill to use even at a basic functioning level and are therefore frequently dangerous to a user. Travel by car, on the other hand, continues to be problematic since the number of cars driven by people who need only travel short distances can contribute to an increased cluttering on roads and therefore force up the cost of gasoline. Issues such as legality, inconvenience, security and weight prevent other products such as inline skates, motorized scooters and Segways from effectively addressing the growing personal transportation problem. Although some interesting motorized scooters exist which do have great gas mileage, they too are problematic since they are considered motorcycles by law and require special permits, turn signals and require the user to mix gasoline with oil to make them run. Motorized scooters therefore tend to be expensive to maintain and operate and give rise to parking issues. Moreover, these scooters are heavy, difficult to ride and very hard to carry, and people under the age of 18 are not permitted to drive them due to legal restrictions. Thus, even potential alternatives are not very convenient for personal transportation purposes.

Published U.S. Patent Application No. 20090120705 to McKinzie discloses a pair of shoes having retractable motorized wheels. Each of the shoes has an upper portion, a sole, and first and second wheels mounted on the sole which are able to move from a retracted to an extended position. When the wheels are in an extended position, one wheel of one of the shoes engages a battery-powered DC motor mounted on the shoe. The motor is controlled by a hand-held throttle. A latching mechanism engages to secure the wheels in the desired position. The shoes may be used for skating, with and without power assistance, with the wheels in an extended position. The shoes may also be used for walking with the wheels in a retracted position. The pair of shoes disclosed in this application, however, lacks an additional battery pack for replacing depleted batteries with fully charged batteries.

Published U.S. Patent Application No. 20040239056 to Cho et al. discloses a wheel assembly for a shoe. A housing is attached to a heel portion of the shoe and defined with an opening. A wheel section is mounted to the housing in a manner such that a pair of wheels of the wheel section can be moved between an operating position. They are received in the opening of the housing to be partially exposed out of a lower surface of the housing and a non-operating position in which they are taken out of the opening of the housing to be seated on a rear end portion of the shoe. The wheel section includes the pair of wheels, a shaft for supporting the pair of wheels, and a support bracket having one end which is connected to the shaft and the other end which is connected to the shoe by a hinge pin. However, the wheel assembly does not provide an adequate safety control for the device and hence there is a risk the wearer may slip if the wearer is not an expert in controlling the wheels.

U.S. Pat. No. 6,572,121 issued to Shih describes a shoe and a wheel device having one end detachably secured together with a projection-and-lock notch engagement. A toe member and a separate heel member are engaged on the front and the rear portions of the shoe. A latch is attached to the wheel device for latching and securing the heel member and the rear portion of the shoe to the wheel device. A quick release lock device is attached to the middle portion of the wheel device and engageable with the heel member for locking the heel member and the middle portion of the shoe to the wheel device. This shoe and wheel combination, however, fails to address the need for a safe and effective way of controlling the speed of rotation of the wheels or a way to quickly stop the device in the event of a fall or other emergency.

Therefore, there is a pressing need for a personal mobility device that is convenient, lightweight and capable of enabling users to easily comply with applicable transportation laws. There is also a need for a personal mobility device that provides an additional battery pack for replacing depleted batteries with fully charged batteries to thereby extend the use time of the device. Further, there is a need for a mobility device that provides users enhanced convenience by enabling them to remove parts of the device and stow them in accessories such as backpacks, belts and battery packs while also providing them with adequate safety controls for controlling the speed and direction of the device.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION

In the description to follow, various aspects of embodiments will be described, and specific configurations will be set forth. These embodiments, however, may be practiced with only some or all aspects, and/or without some of these specific details. In other instances, well-known features are omitted or simplified in order not to obscure important aspects of the embodiments.

Figure 1:
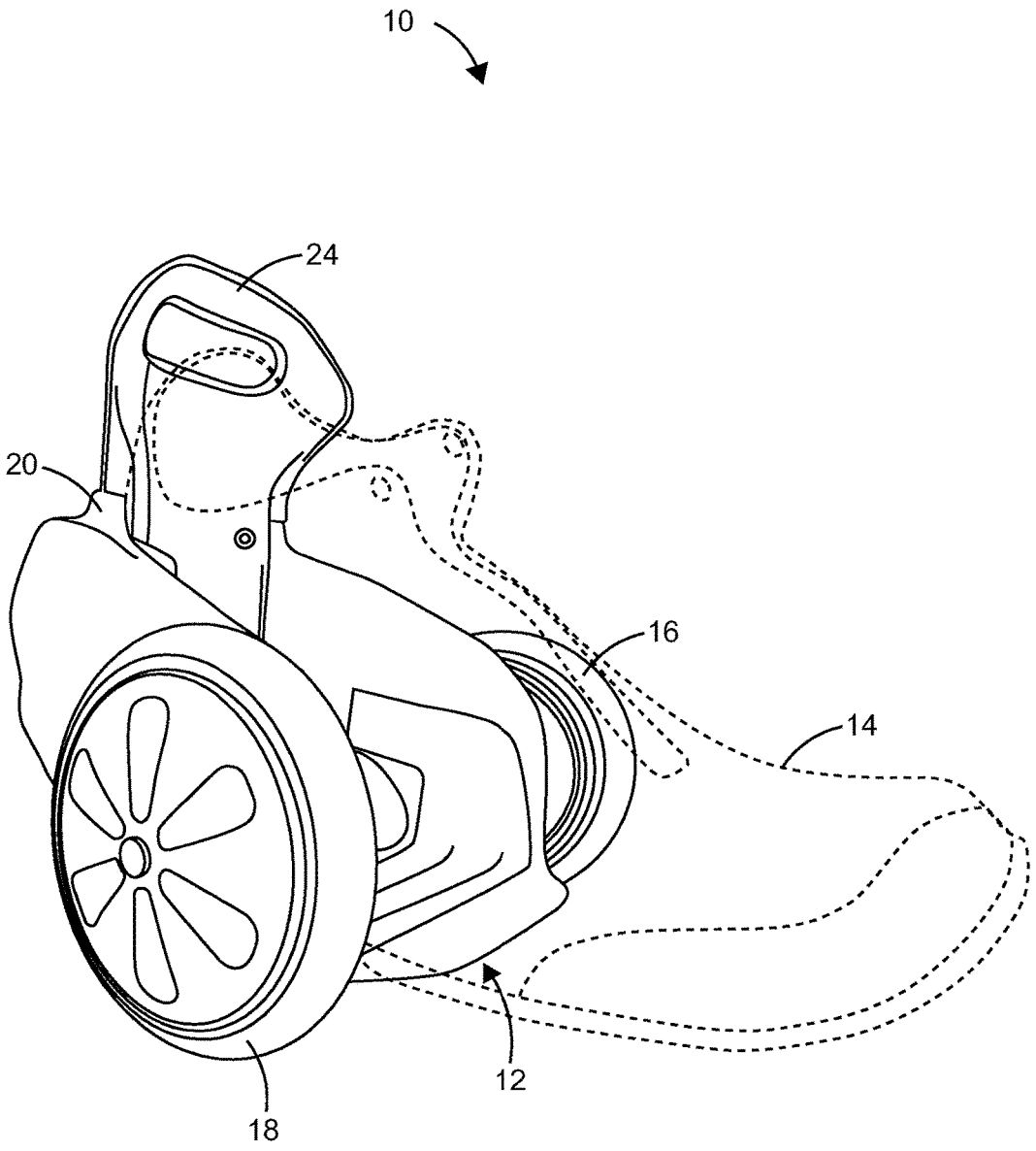
FIG. 1 is a perspective view of a wearable mobility device in an embodiment.
Figure 2:
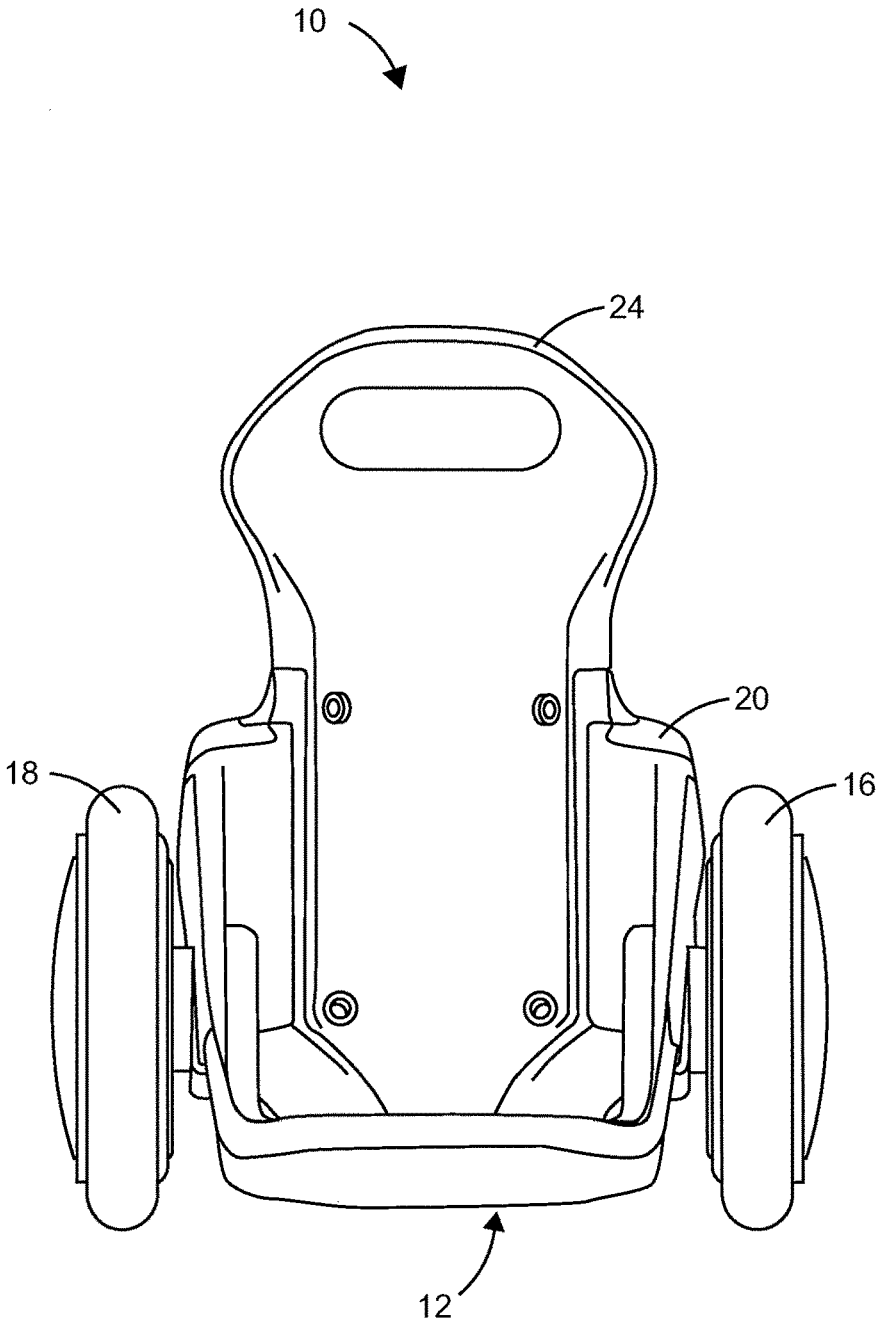
FIG. 2 is a front view of a wearable mobility device in an embodiment.

FIGS. 1 and 2 show the preferred embodiment, illustrating a wearable mobility device 10. The mobility device 10 for personal transportation comprising a base 12 for placement of a shoe 14 wherein the base 12 includes a battery pack 20, a tail reflector (not shown), and a wireless receiver (not shown). The mobility device 10 includes a first wheel 16 having a wheel hub motor (not shown) embedded therein, the wheel hub motor (not shown) is rotatably connected to a first partial axial shaft (not shown) connected to the base 12, the first wheel 16 having a diameter equal to at least 5.5 inches. A second wheel 18 having a wheel hub motor controller (not shown) embedded therein, the wheel hub motor controller (not shown) is rotatably connected to a second partial axial shaft (not shown) connected to the base 12. The second wheel 18 has a diameter equal to the diameter of the first wheel 16. A remote control (not shown) is employed for controlling the speed and direction of the mobility device 10. The remote control (not shown) transmits one or more control signals to the wireless receiver (not shown), the remote control is (not shown) mounted on the wrist of a user (not shown) of the mobility device 10. The motor controller (not shown) embedded in the mobility device 10 is suitable for use on pedestrian travel surfaces and to walk, scoot, roll and to drive a car without the need for removing the shoe 14. The base 12 and the battery pack (not shown) of the mobility device 10 may function as a shock absorber for the heel of the user (not shown). The power transmitted from the wheel hub motor (not shown) to the first wheel 16 and the second wheel 18 is responsible for the motion of the mobility device 10. The mobility device 10 can be removed and stored in a backpack accessory (not shown) when not in use. The first wheel 16 and the second wheel 18 enable the mobility device 10 to move forward and rearward. The first wheel 16 and the second wheel 18 include a suspension/tensioner feature. The first wheel 16 and the second wheel 18 hold steady using a locking device (not shown). The mobility device 10 includes a handle flap 24 which in one embodiment is made of rubber material.

Figure 3:
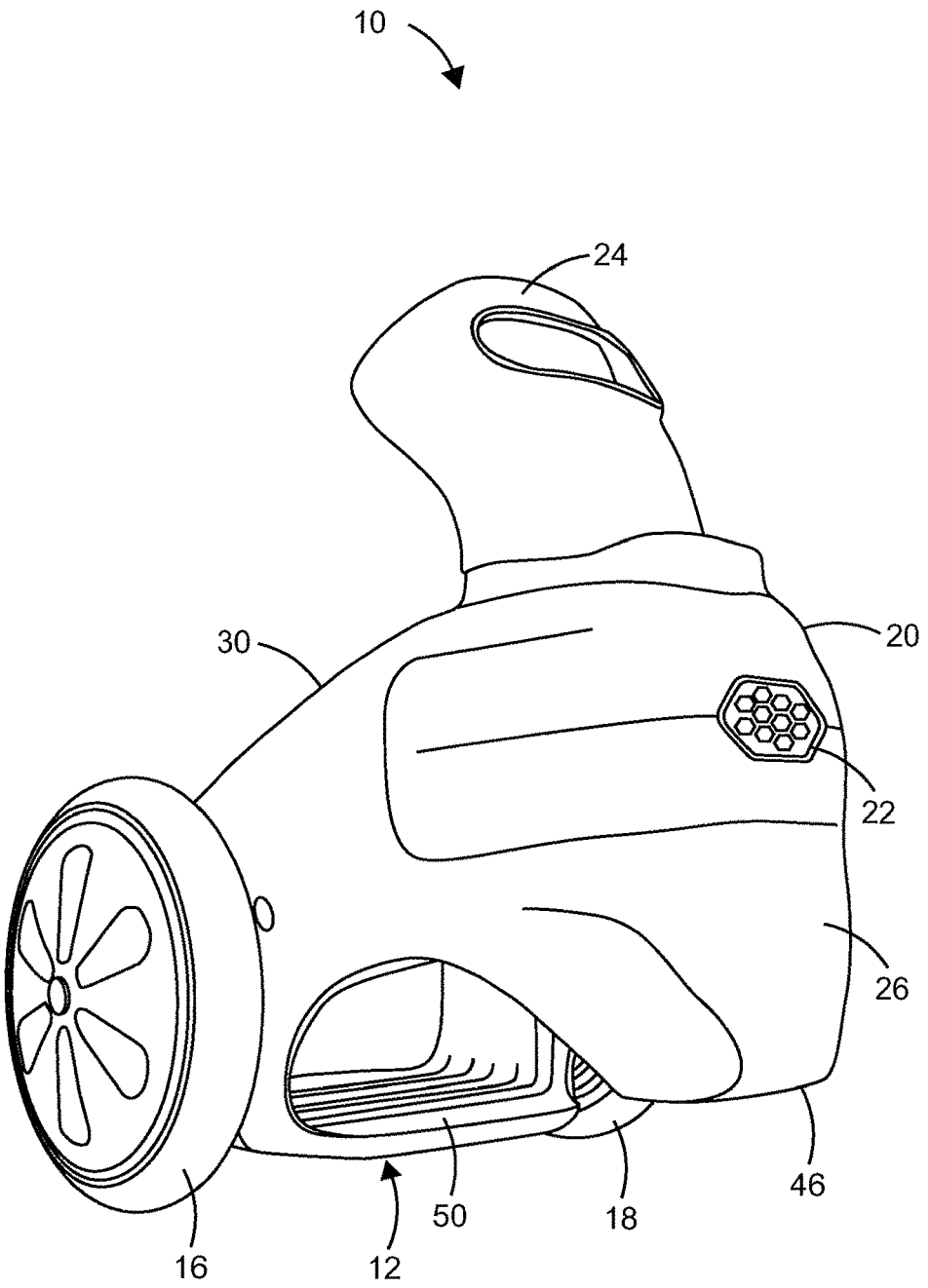
FIG. 3 is a rear perspective view of a wearable mobility device in an embodiment.

FIG. 3 shows a rear perspective view of a wearable mobility device 10. The base 12 also includes a bracket 30 that acts as a brace for a wearer's shoe and as a standing platform for the user (not shown). In the present embodiment, the base 12 includes a heel-support section 46 to provide comfort for the heel of the user (not shown). The battery pack 20 in the mobility device 10 stores a plurality of rechargeable batteries (not shown). The battery pack 20 is removable and rechargeable when the mobility device is not in use. However, the battery pack 20 can be charged while included in or removed from the mobility device 10. The battery pack 20 includes a tail reflector 22 to make the device 10 noticeable at night. In an alternative embodiment, the battery pack 20 can be mounted to the calf of the rouser (not shown). In one embodiment, the batteries (not shown) used in the mobility device 10 are lithium polymer batteries, while in an alternative embodiment the batteries used are in the device 10 are nanophosphate batteries. In another embodiment, the batteries used in the mobility device 10 are lithium ion batteries. The battery pack 20 includes a plurality of windows (not shown) which illuminate to show the charge status of the battery pack 20. In an embodiment, the battery pack 20 includes a battery charging port (not shown) which can charge the battery pack 20 from any wall socket (not shown). The battery charging port (not shown) transfers electrical power from the wall socket (not shown) to the plurality of batteries (not shown) in the battery pack 20 of the wearable mobility device 10 to enables them to recharge. In an alternative embodiment, the plurality of batteries (not shown) may be adapted for recharging from a solar panel (not shown). The battery pack 20 may be integrated to the mobility device 10 in a removable section connected by the battery charging port (not shown). The handle flap 24 provided with the mobility device 10 can be utilized as a handle and as a shock absorber for the heel of the user (not shown). A wireless receiver (not shown) is included in a back cavity 26 under the battery pack of the mobility device 10 to communicate with a hand-mounted remote control (not shown).

Figure 4:
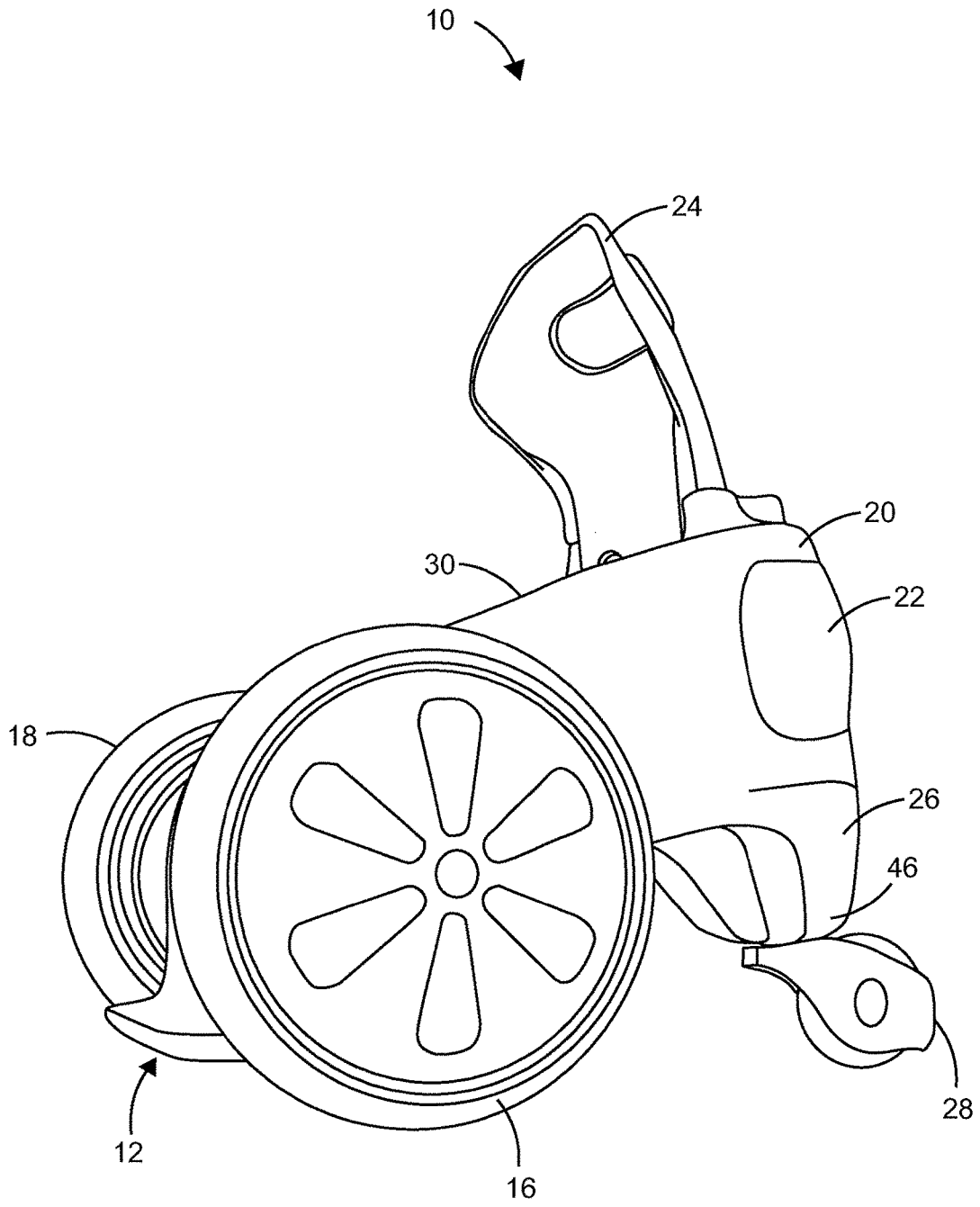
FIG. 4 is a left perspective view of a wearable mobility device having a training wheel in an embodiment.
Figure 5:
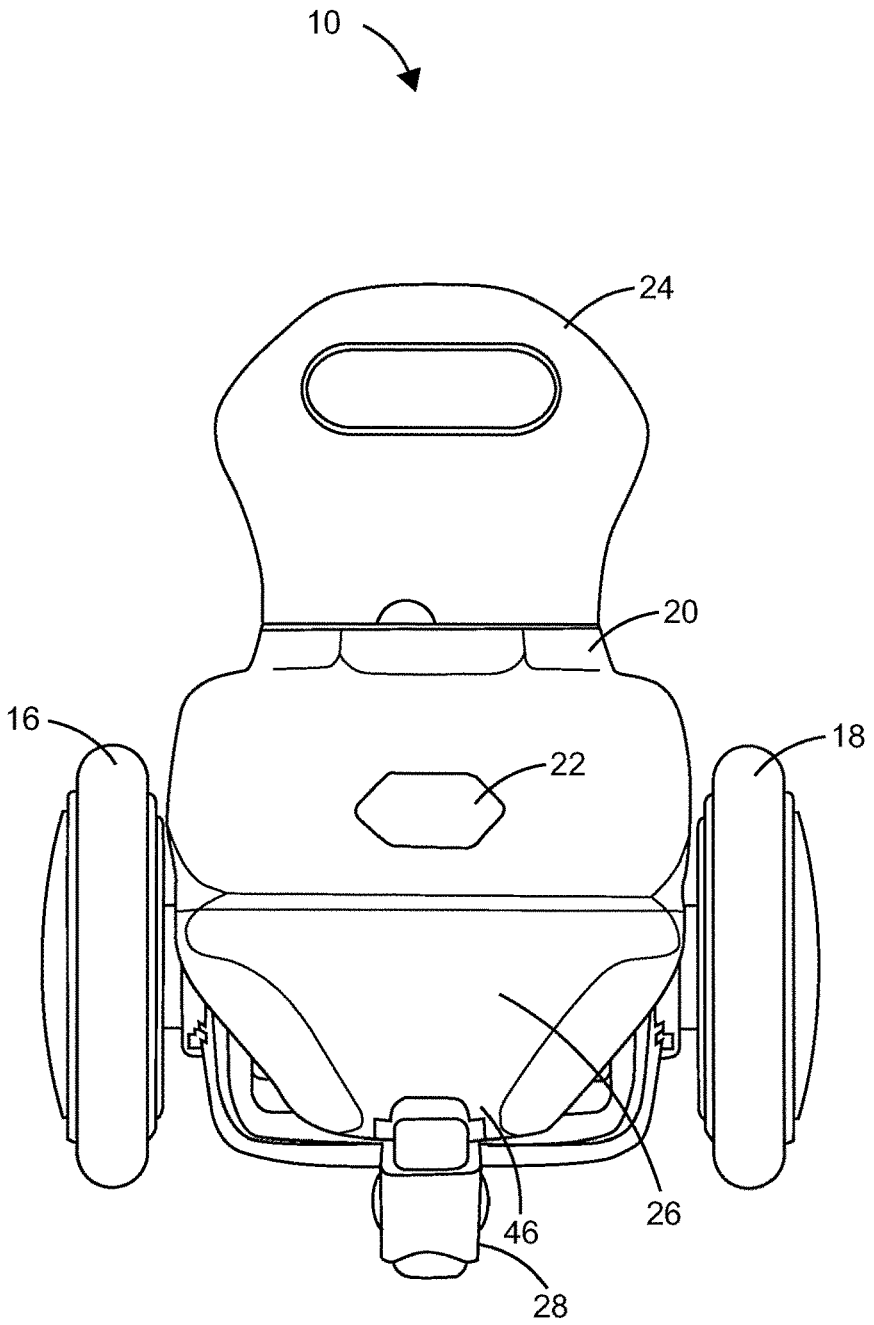
FIG. 5 is a rear side view of a wearable mobile device having a training wheel in an embodiment.

FIGS. 4 and 5 illustrate the wearable mobility device 10 having a third wheel 28 employed for the purpose of training. In this embodiment, the mobility device 10 includes the third wheel 28 to facilitate the utilization of the mobility device 10 by an untrained user. In an alternative embodiment, the third wheel can be removed by the user and replaced with a stopper-type brake similar to the type used on roller skates. The mobility device 10 enables a user to take any form of public transportation. The mobility device 10 can be dismantled and its parts can be stored in a pocket or in an accessory such as a backpack, bag or portable carrier.

Figure 6:
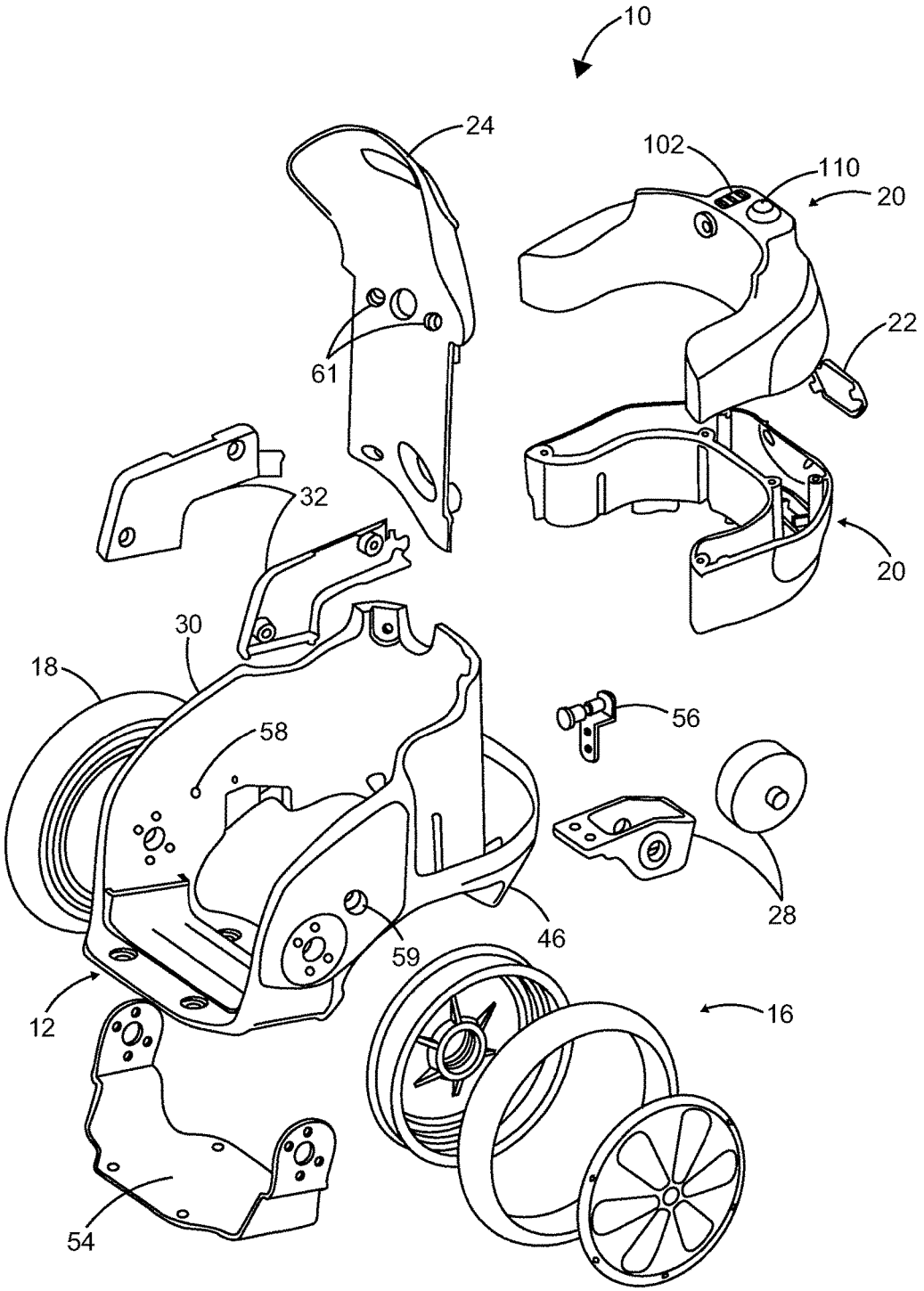
FIG. 6 is an exploded view of an embodiment of a wearable mobility device.

FIG. 6 is an exploded view of the preferred embodiment of the wearable mobility device 10. The mobility device 10 includes the base 12 for placement of the shoe (not shown). The base 12 includes a bracket 30 for a wearer's foot and a means to connect the first wheel 16 and the second wheel 18. An aluminum reinforcing brace 54 is provided as a supporting member on the bracket 30 to prevent wear and tear and to enable the first wheel and the second wheel to have a consistent, strengthened structure upon which they can be mounted. A pair of wire covers 32 is provided to cover a plurality of wires (not shown) in the wheel hub motor (not shown) and the wheel hub motor controller (not shown) of the mobility device 10. The mobility device 10 includes a third wheel 28 for training purposes. The handle flap 24 is inserted into the bracket 30 and acts as a shock absorber. The handle flap 24 also serves as a fitting device that conforms to the user's foot to provide a more customized fit. The battery pack 20 includes a spatial region (not shown) for inserting and storing the plurality of batteries (not shown). The tail reflector 22 is employed to make the mobility device 10 noticeable during night time. The battery pack 20 includes a switch 110 and a Light Emitting Diode (LED) battery meter 102. The switch 110 is used to power the mobility device 10 on and off, and the LED battery meter is used to show the charge status of the plurality of batteries (not shown). The battery pack 20 includes a releasing mechanism 56 to separate the battery pack 20 from the base 12. A plurality of holes 61 are provided on an inner face of the handle flap 24 to hold bolts securing a ladder strap and a ratchet strap which are employed across an upper portion of a wearer's foot. Additionally, a first hole 58 is present on an inner face of the bracket 30 to hold a bolt attached to a ladder strap (not shown) and a second hole 58 is present on an opposing inner face of the bracket 30 to hold a bolt attached to a ratchet strap (not shown). The ladder strap and the ratchet strap secured to the bracket 30 are used to secure the shoe 14 to the mobility device 10 and are employed across a lower-middle portion of the shoe covering the instep of a wearer's foot.

Figure 7:
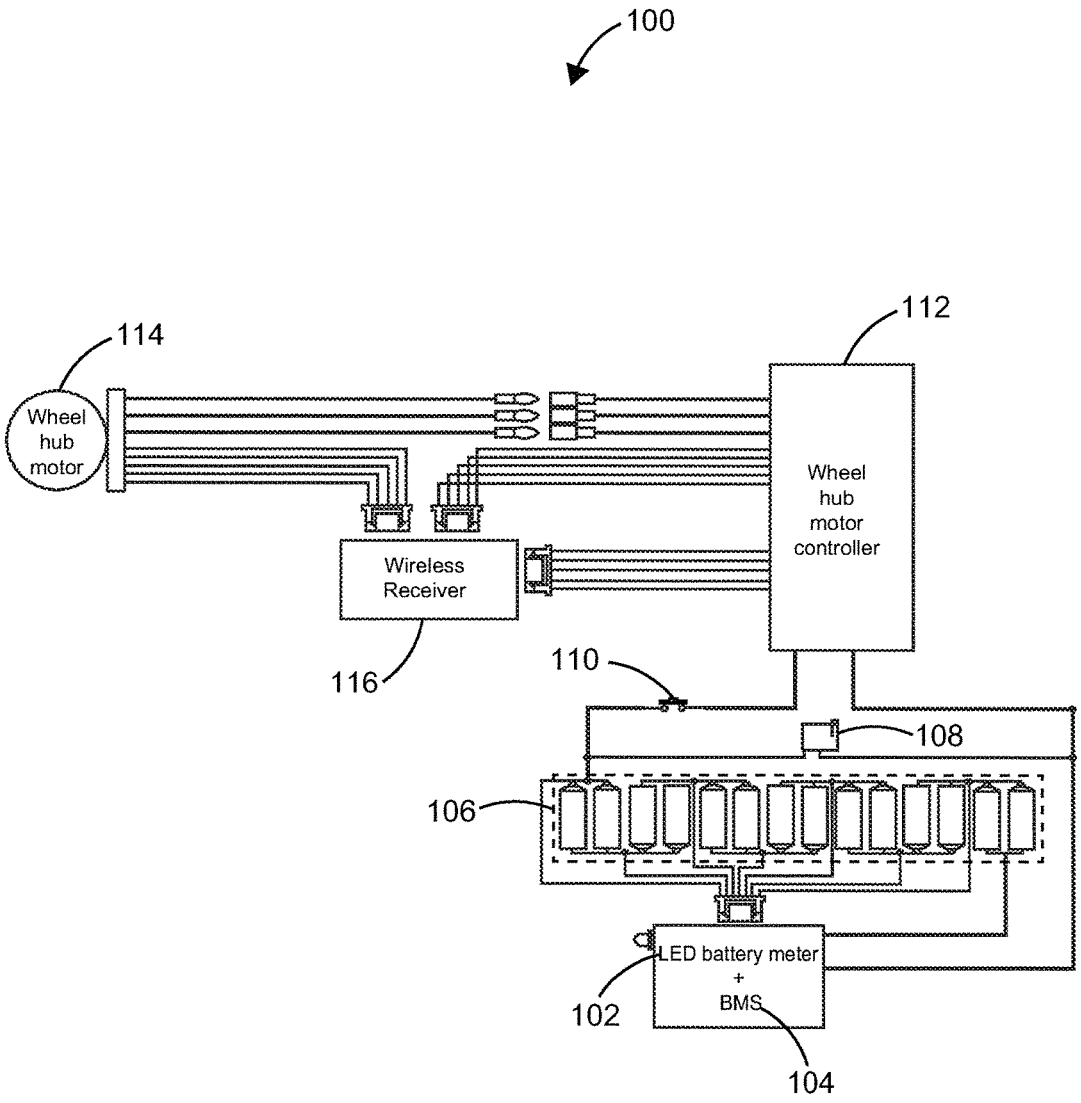
FIG. 7 is an electrical schematic diagram illustrating the operative electrical components of a wearable mobility device in an embodiment.

FIG. 7 is an electrical schematic diagram 100 for a wearable mobility device 10. The diagram 100 illustrates electrically coupled connections between the LED battery meter 102, a battery management system (BMS) 104, the plurality of batteries 106 connected in a series/parallel configuration, a battery charging port 108, the switch 110, the wheel hub motor controller 112, the wheel hub motor 114 and the wireless receiver 116. In the illustrated embodiment, the wireless receiver 116 is electrically coupled to the wheel hub motor 114 and the wheel hub motor controller 112. In an alternative embodiment, the wireless receiver 116 is electrically coupled to the wheel hub motor controller 112 to which control signals are transmitted for control and operation of the wheel hub motor 114. The LED battery meter 102 and the BMS 104 are electrically coupled to the plurality of batteries 106. The plurality of batteries 106 can be charged by utilizing the battery charging port 108. The wheel hub motor controller 112 controls the speed of rotation and the direction of travel (i.e., forward or backward) of the wheels of the mobility device 10 after receiving one or more control signals from a remote control through the wireless receiver.

Figure 8:
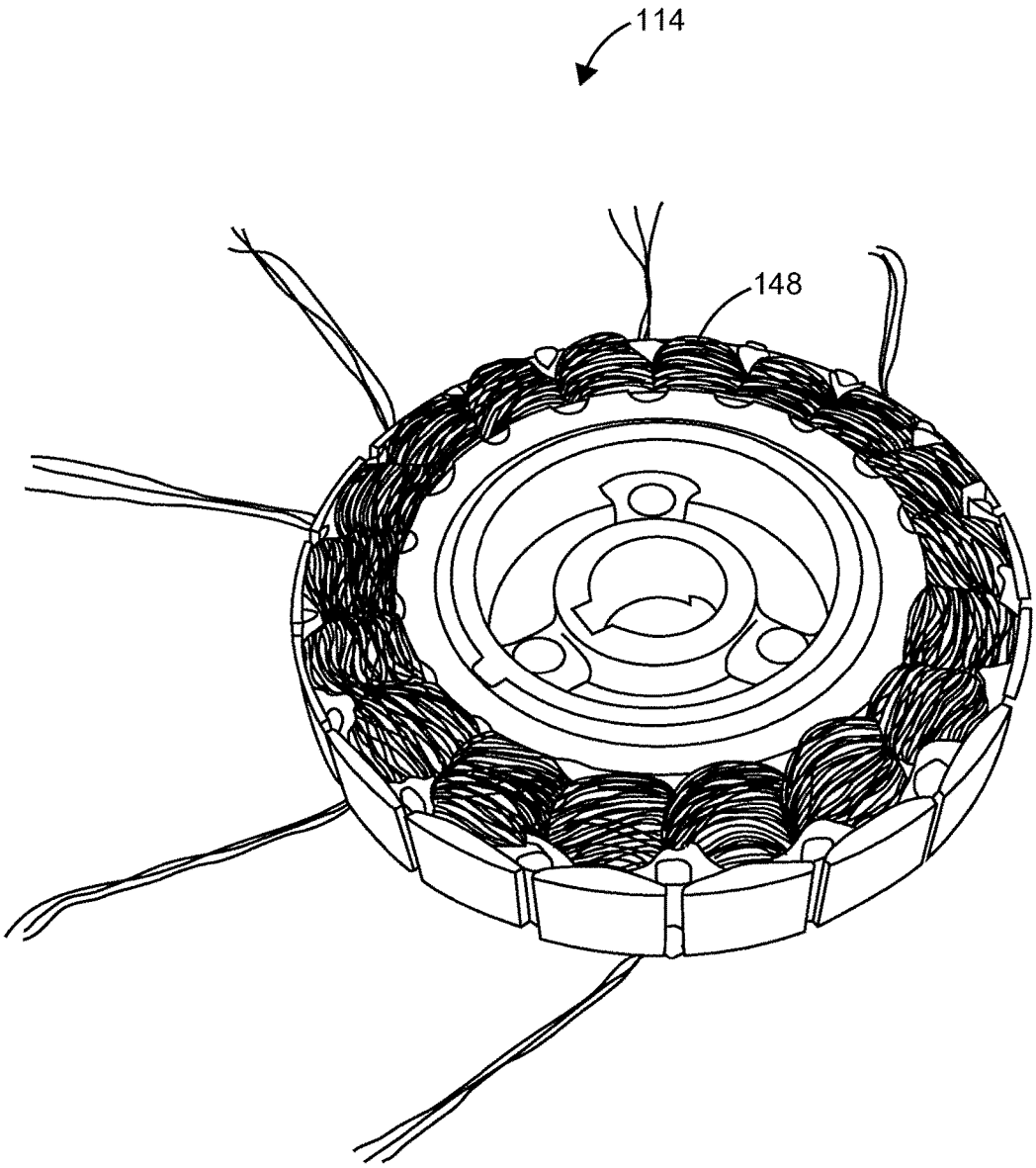
FIG. 8 illustrates a wheel hub motor for a wearable mobility device in an embodiment.

FIG. 8 is an illustration of a wheel hub motor 114 in the wearable mobility device 10. The wheel hub motor 114 is rotatably connected to the first partial axial shaft (not shown) which is connected to the base 12 of the mobility device 10. The hub motor 114 is a brushless direct current electric motor that includes a plurality of coil windings 148 and is positioned around the partial axial shaft (not shown). In one embodiment, the mobility device 10 utilizes an eighty watt (80W) motor and its speed is controlled by a controller which receives one or more control signals from a remote control (not shown).

Figure 9:
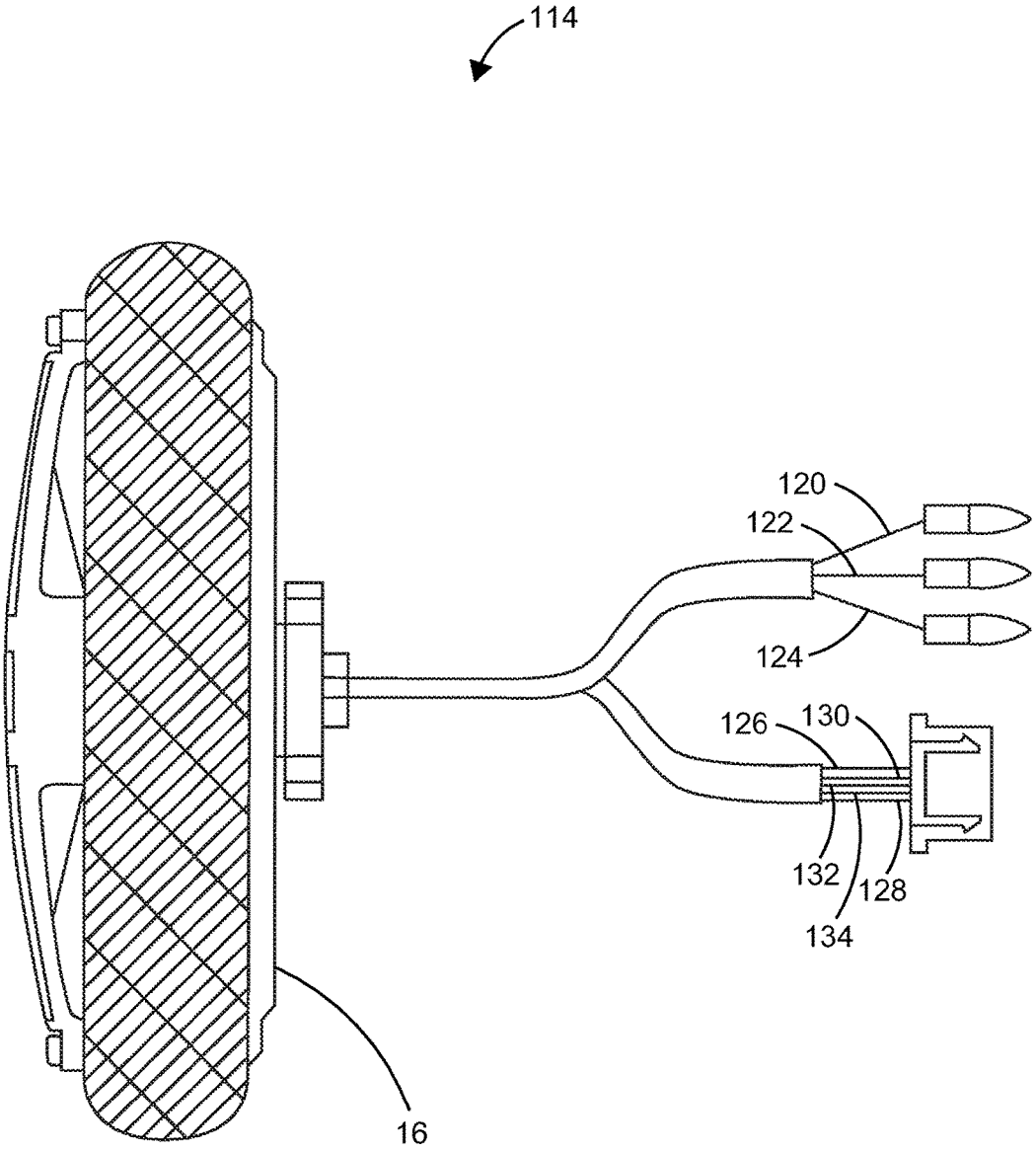
FIG. 9 is a schematic representation of electrical connections to a wheel hub motor in a wearable mobility device in an embodiment.

FIG. 9 is a schematic representation of the electrical connections to a wheel hub motor 114 in a wearable mobility device 10. In one embodiment, the hub motor 114 is a permanent magnet brushless DC (Direct Current) motor. The hub motor 114 includes three terminals and they are respectively, a Motor A section 120, a Motor B section 122, and a Motor C section 124. The hub motor 114 can operated at various operating voltages in the mobility device 10. In the preferred embodiment, the hub motor 114 is operative with a voltage of 24 volts DC. The hub motor 114 operates with 80W power and has a maximum speed of 650 rpm (rotations per minute). The power and speed may vary according to the voltage used in the motor. In the preferred embodiment, the hub motor 114 uses three Hall Effect sensors to detect speed, which sensors are Motor Hall signal A 130, Motor Hall signal B 132, and Motor Hall signal C 134. A +5 VDC power supply line 126 and a Ground supply line 128 are internally connected to the three sensors.

Figure 10:
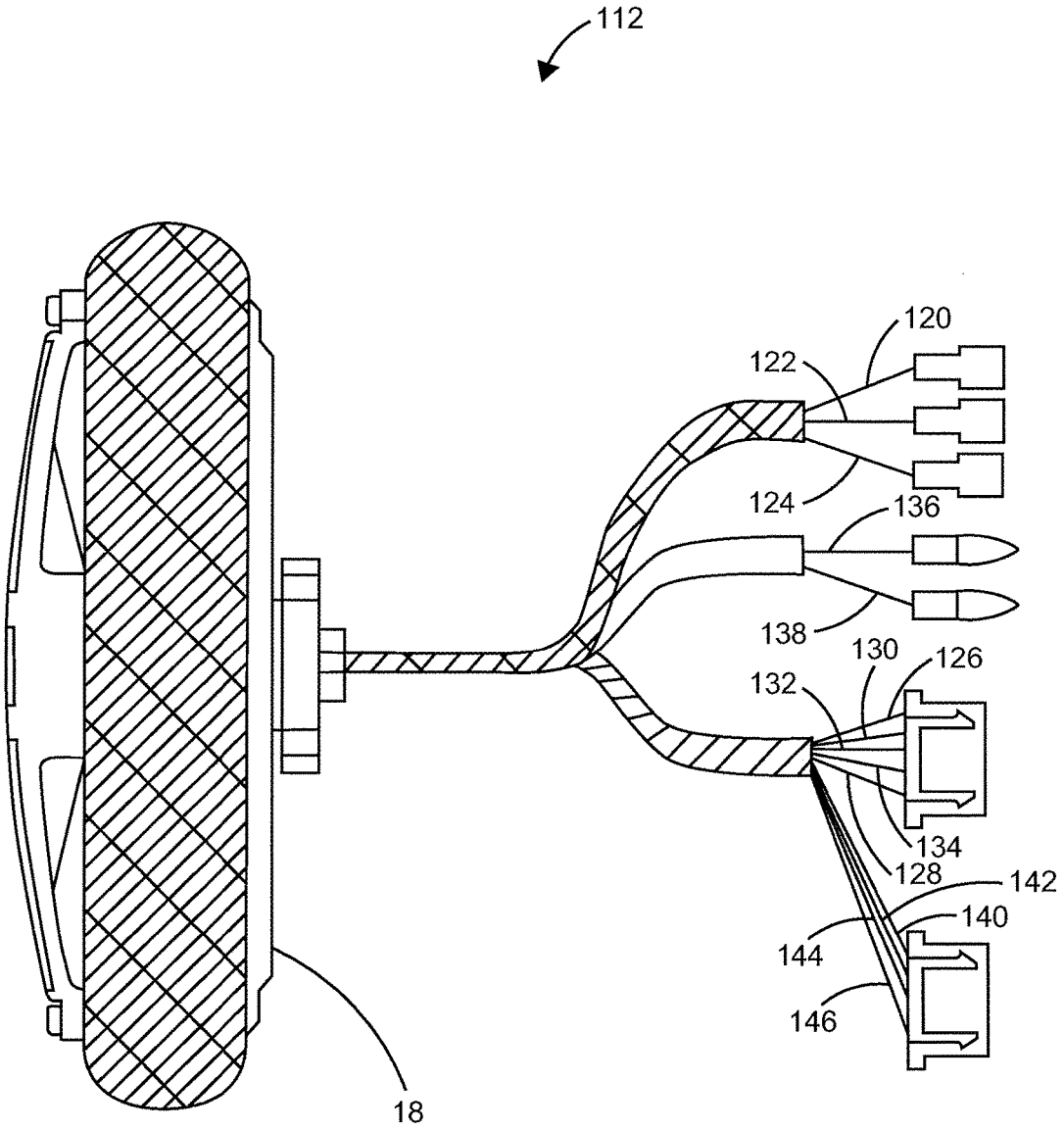
FIG. 10 is a schematic representation of electrical connections to a wheel hub motor controller in a wearable mobility device in an embodiment.

FIG. 10 is a schematic representation of the electrical connections to a wheel hub motor controller 112 in a wearable mobility device 10. A three phase motor controller using 24V DC operating voltage is used in the preferred embodiment. The controller under voltage value is twenty-one volts (21 Volts) DC and the controller limiting value is 8 Amperes. The terminals on the wheel hub motor controller 112 that are coupled to the wheel hub motor 114 are the Motor A section 120, the Motor B section 122 and the Motor C section 124. The controller power is adjusted using two control lines 136 and 138. The motor controller 112 includes three Hall Effect Sensors 130, 132, 134 to detect the speed of the wheel hub motor 114. The +5 VDC power supply line 126 and the Ground supply line 128 are internally connected to all three sensors. In addition to providing electrical power to the wheel hub motor 114, the wheel hub motor controller 112 also provide electrical power to the wireless receiver 26 which is electrically coupled to the motor controller 112 from the base 12. In one embodiment, the wheel hub motor controller includes a wireless receiver power supply line 140 on which a voltage of +5V is provided, a ground supply line 144, a remote control receiver signal line 142, and a controller reversible control line 146 to communicate back to the wireless receiver 116.

Figure 11:
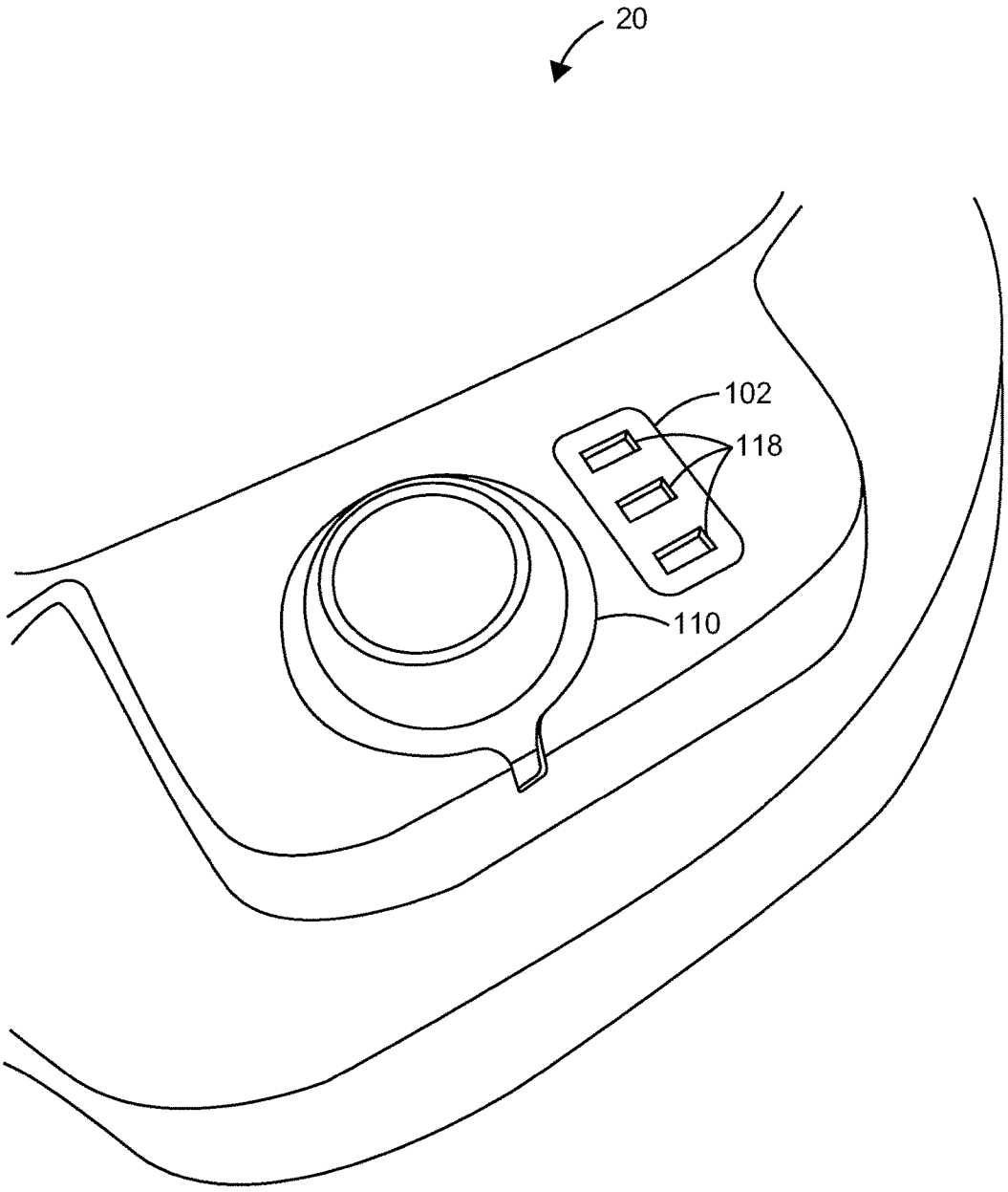
FIG. 11 is a perspective view of a switch and a light emitting diode battery meter on a battery pack of a wearable mobility device in an embodiment.

FIG. 11 is a perspective view of the switch 110 and the LED battery meter 102 on the battery pack 20 in the wearable mobility device 10. The battery pack 20 includes the switch 110 and the LED battery meter 102 to display the current status of the charge available in the plurality of batteries (not shown). The LED battery meter 102 includes a plurality of windows 118 which displays a green light, a yellow light and a red light. The green light indicates an adequate amount of charge in the plurality of batteries 106, a yellow light indicates batteries in need of charging, and the red light indicates low battery charge.

Figure 12:
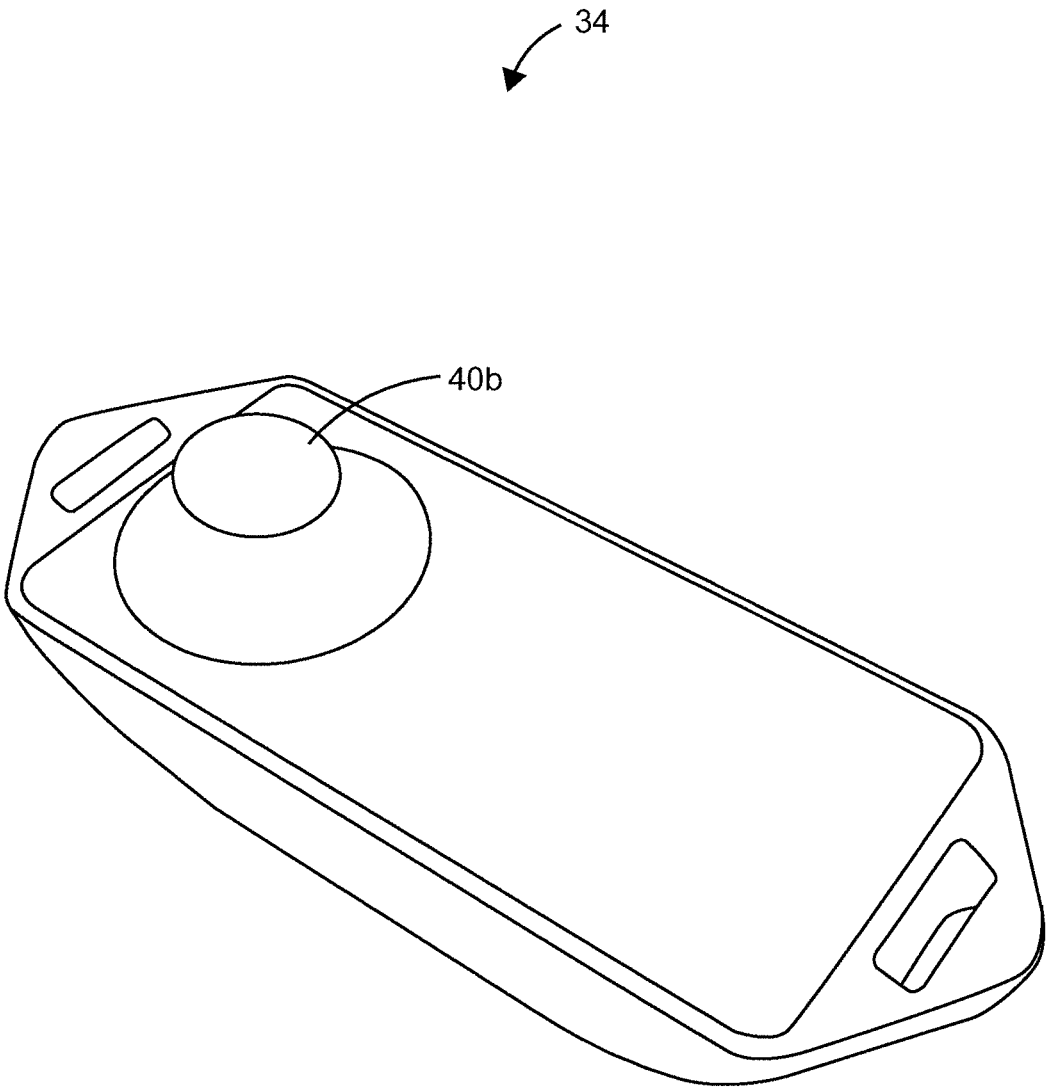
FIG. 12 is a side perspective view of a remote control used to control a wearable mobility device in an embodiment.

FIG. 12 shows a side perspective view of a remote control 34 in one embodiment. The remote control 34 is used to transmit one or more control signals to a wireless receiver which are transmitted to a wheel hub motor controller for the purpose of controlling the speed and direction (i.e., forward or backward) of the mobility device 10. In an embodiment, the remote control 34 includes a knob **40*b* coupled to a continuously variable switch that is employed for activation and motion control of the mobility device 10. The knob is continuously pushed to maintain motion while the remote control 34 is held in the palm of a user. If the knob 40*b* is released or in the event of a fall the knob will automatically move to a central position to de-activate the mobility device 10. The remote control 34 may also include a strap (not shown) to keep the remote control 34** on a user's hand (not shown) and an LED operational status indicator (not shown) which is powered on when the remote control is switched on.

Figure 13A:
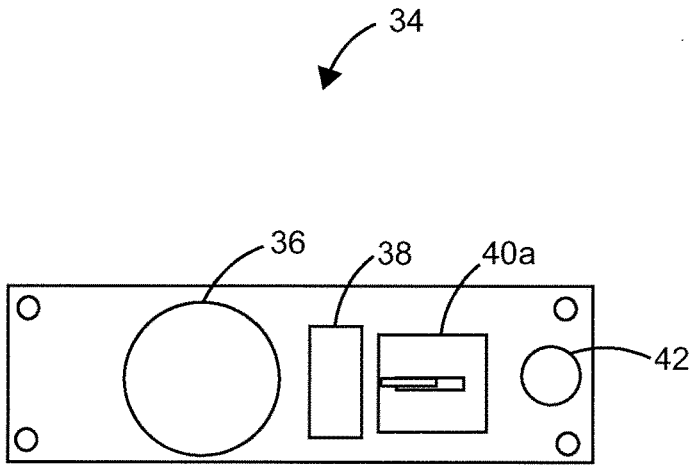
FIG. 13A is a schematic representation illustrating a top view of a remote control for a wearable mobility device in an embodiment.

FIG. 13A shows a schematic representation of the internal components of the remote control 34 in an embodiment. The remote control 34 includes a battery 36, a central processing unit (CPU) 38, a continuously variable switch 40*a* and a receiver 42. The remote control 34 can transmit one or more control signals to the wireless receiver 116 embedded in the mobility device 10 and can receive reply signals from the mobility device 10 on the receiver 42. The speed of the mobility device 10 can be adjusted by the controller based on one or more control signals transmitted from the remote control 34.

Figure 13B:
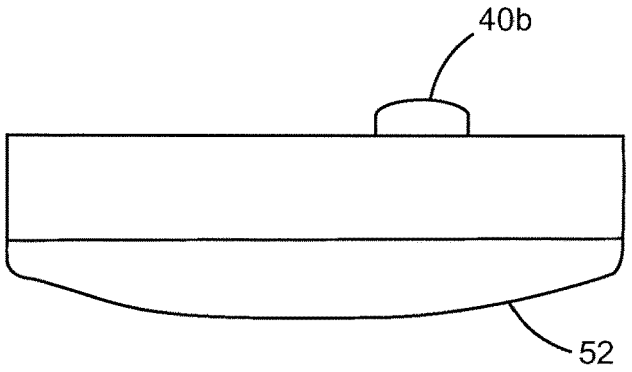
FIG. 13B is a schematic representation illustrating a side perspective view of a remote control for a wearable mobility device in an embodiment.

FIG. 13B shows the front side external view of the remote control 34. In the illustrated embodiment, a knob 40*b* on an upper external surface of the remote control 34 is a circular button that can be pushed forward or backward and is coupled to the continuously variable switch 40*a* internal to the remote control 34. The remote control includes a guard band 52 for mounting onto the wrist of a user (not shown).

Figure 14:
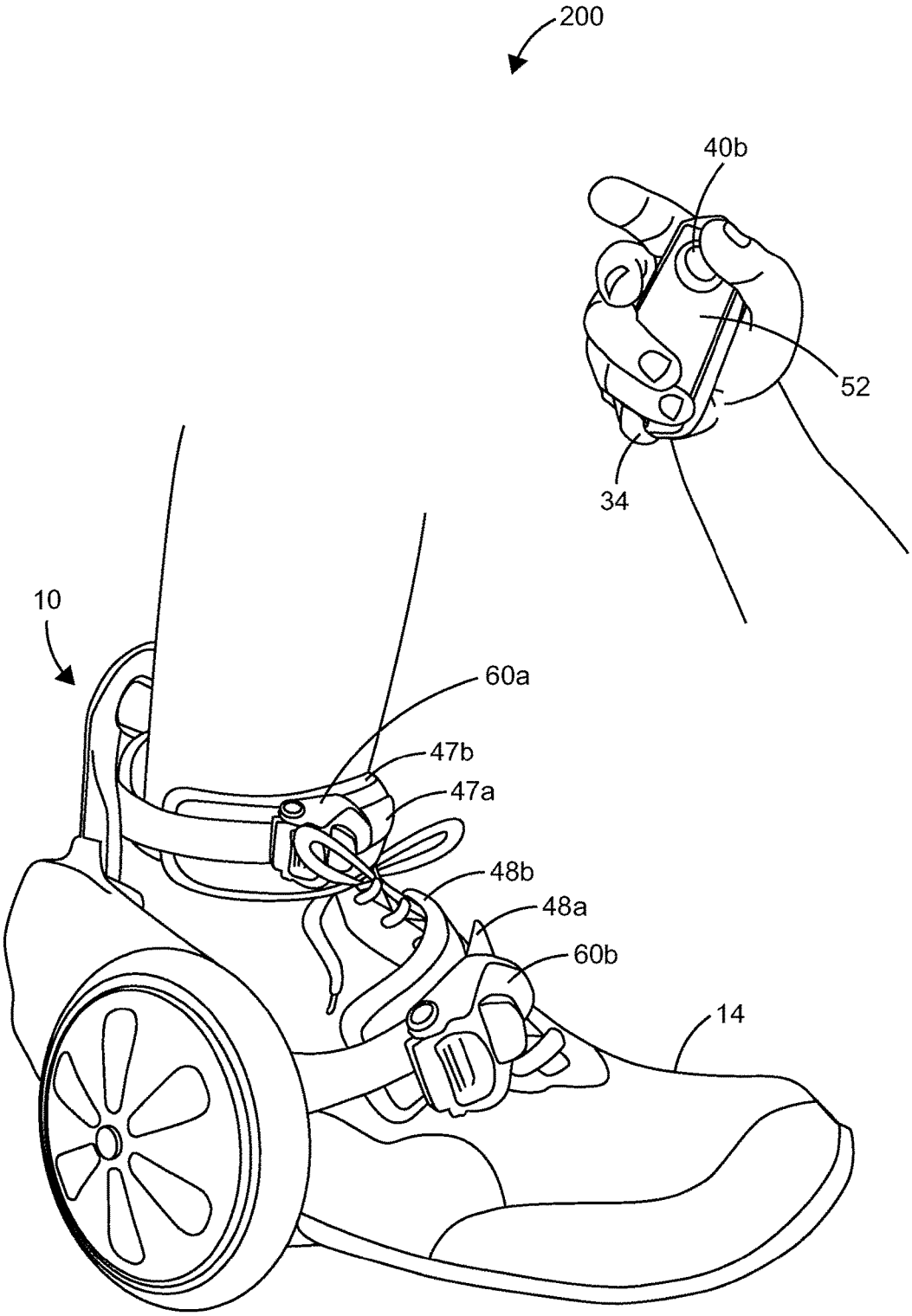
FIG. 14 illustrates a use of a wearable mobility device in an embodiment.

FIG. 14 illustrates the wearable mobility device 10 in use. In one embodiment, the wearable mobility device 10 is secured to the shoe 14 of a user (not shown) employing two different sets of straps, both of which include a ladder strap and a ratchet strap. In one embodiment, each set of straps is locked using a centrally located locking clasp 60*a*, 60*b*. In an alternative embodiment, each set of straps is locked using a side located locking clasp (not shown). As shown here, an upper ladder strap 47*a* and ratchet strap 47*b* serve to strap the upper portion of a wearer's foot to the rear portion of the bracket 30 and the handle flap 24. A lower ladder strap 48*a* and ratchet strap 48*b* are used to strap or restrain the lower-middle portion of a wearer's shoe connecting and covering the instep of a wearer's foot to the bracket 30. The user (not shown) uses the remote control 34 to control the speed and braking action of the mobility device 10. More specifically, a user can push or pull the knob 40*b* on the remote control 34 to control the forward and backward motion of the mobility device 10. The mobility device 10 provides an elegant look for the user's shoe 14 while enabling a user (not shown) to walk, roll, scoot and to even drive a car. In another embodiment, the motor and gearbox are on a swinging arm that presses back against the user's leg so that it will always remain under the user's pants. As power is applied to the motor, it automatically moves against the shin of the user.

Figure 15:
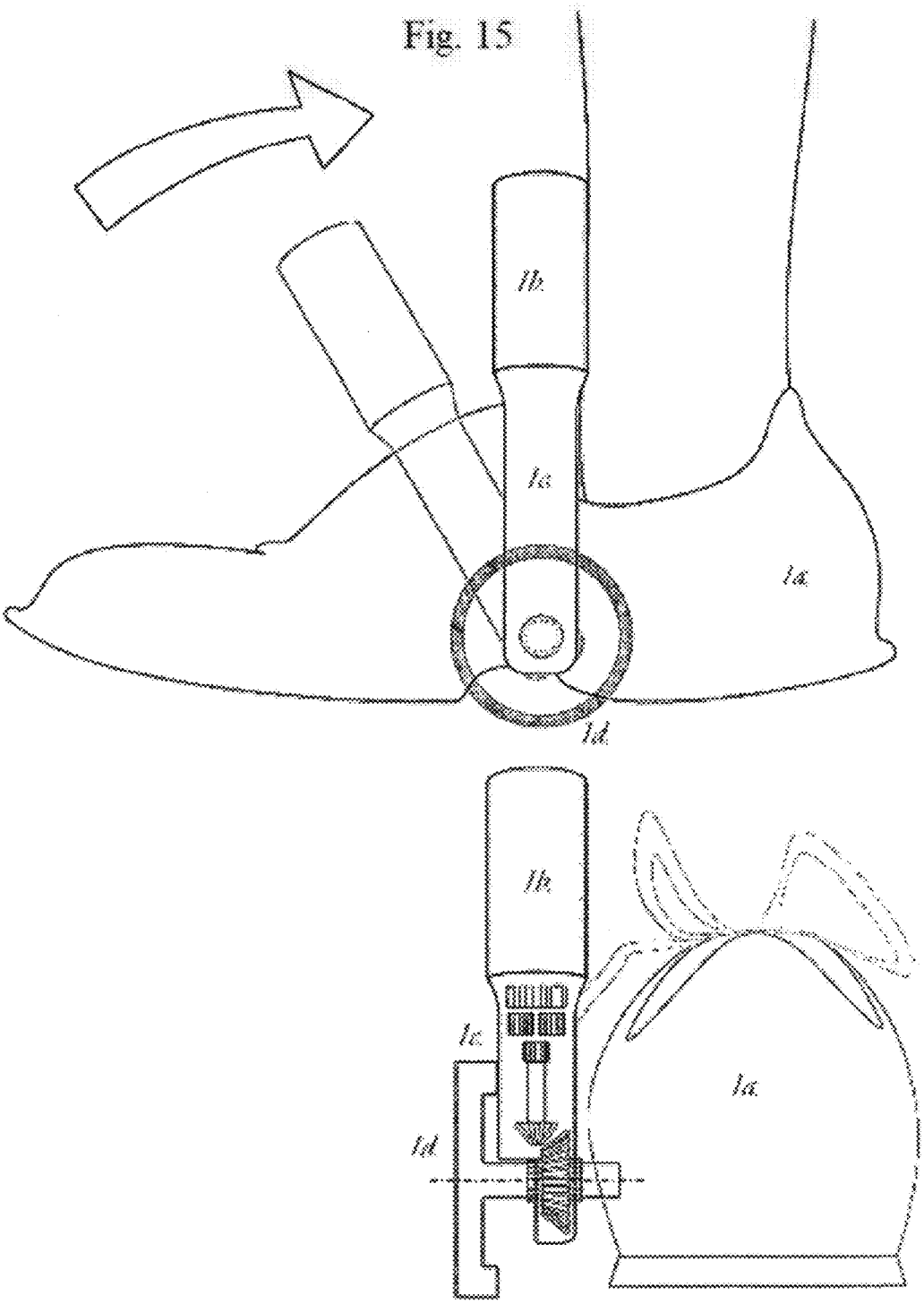
FIG. 15 shows a continuously adjustable motor housing.

FIG. 15 is another version where motor 1*b* and gearbox 1*c* are on a swinging arm that presses back against the user's leg so that it will remain under the user's pants. Motor 1*b* may drive wheel 1*d*. This is an integration function that both conceals and streamlines the wearable mobility device to make it easier and more comfortable to use. As power is applied to motor 1*b*, it automatically moves against the shin of the user. This also makes it easier to take shoes 1*a* off, because the motor will slide out of the way so the laces or other means of attachment can be easily accessed.

Although specific embodiments have been illustrated and described herein, it will be appreciated by those of ordinary skill in the art that a wide variety of alternate and/or equivalent implementations may be substituted for the specific embodiments shown and described herein without departing from the scope of the present disclosure. For example, in one alternative embodiment, a wireless version of the device 10 is provided in which all parts are housed in the shoes except for the hand controller. In an additional alternative embodiment, the device 10 does not need a hand control and the functionality of the device 10 is controlled by other parts of the body using weight distribution detection software and/or hardware or other means so as to provide a greater range of adjustability with the motors, gears and belts to customize the device 10 to a wearer's specific needs. In a still further embodiment, a wired version of the device 10 includes a belt to secure the device 10 to the wearer's body. In this embodiment, the battery pack and the remote control are extended from the belt and a hand-held remote control is electrically coupled to the belt and control signals from the remote are transmitted over electrical wiring directly to a motor controller embedded in a shoe. This application is intended to cover any such adaptations or variations of the embodiments discussed herein.

What is claimed is:

1. A wearable mobility device for personal transportation, the device comprising:

a base for placement of a shoe, and a battery pack;

a wheel connected to the base;

a motor connected to the wheel through a shaft and a set of gears;

wherein the motor receives electrical power from the battery pack to drive the wheel to rotate through the shaft and the set of gears;

wherein the motor is included in a swing arm and the swing arm is mounted on the wheel; and wherein the swing arm is configured to swing back against a user wearing the wearable mobility device.

2. The wearable mobility device of claim 1 wherein the battery pack includes a plurality of rechargeable batteries.

3. The wearable mobility device of claim 1 wherein the set of gears is a gearbox configured to reduce a rotational speed of the shaft driven by the motor.

4. The wearable mobility device of claim 3 wherein the gearbox is configured to increase a torque level to that required for moving a weight of a user wearing the wearable mobility device.

5. The wearable mobility device of claim 1 wherein the battery pack is removable.

6. The wearable mobility device of claim 1 wherein the battery pack includes a taillight.

7. The wearable mobility device of claim 1 wherein the battery pack is mounted on to the back of the base.

8. The wearable mobility device of claim 1 wherein the battery pack is removable and rechargeable when not in use.

9. The wearable mobility device of claim 1 wherein the wheel is a track system.

10. The wearable mobility device of claim 1 wherein the base further comprises a tail reflector.

11. The wearable mobility device of claim 1 wherein the motor is configured to drive the wheel through the shaft and the set of gears to enable the mobility device to move forward.

12. The wearable mobility device of claim 11 wherein the motor is configured to drive the wheel through the shaft and the set of gears to enable the mobility device to move rearward.

13. An apparatus for transporting a user, the apparatus comprising:

a standing platform for the user to place a shoe and stand on;

a wheel rotatably coupled to the standing platform;

a motor having a shaft;

a gearbox coupled to the shaft and the wheel and comprising a plurality of gears; and a battery pack coupled to the motor and configured to provide electrical power to the motor;

wherein the motor is configured to drive the plurality of gears to rotate the wheel to enable the apparatus to move; and wherein the motor is included in a swing arm and the swing arm is mounted on the wheel; and wherein the swing arm is configured to swing back against a user wearing the wearable mobility device.

* * * * *